US009010497B2

(12) United States Patent
Saarelainen et al.

(10) Patent No.: US 9,010,497 B2
(45) Date of Patent: Apr. 21, 2015

(54) DIVERTING PULLEY ARRANGEMENT AND ELEVATOR

(75) Inventors: Antti Saarelainen, Espoo (FI); Petteri Valjus, Helsinki (FI); Jaakko Kalliomäki, Vantaa (FI); Jukka Norja, Hyvinkää (FI); Albu Razvan, Hyvinkää (FI)

(73) Assignee: Kone Corporation, Helsinki (FI)

( * ) Notice: Subject to any disclaimer, the term of this patent is extended or adjusted under 35 U.S.C. 154(b) by 202 days.

(21) Appl. No.: 13/208,632

(22) Filed: Aug. 12, 2011

(65) Prior Publication Data

US 2011/0308892 A1 Dec. 22, 2011

Related U.S. Application Data

(63) Continuation of application No. PCT/FI2010/000019, filed on Mar. 11, 2010.

(30) Foreign Application Priority Data

Mar. 12, 2009 (FI) ..... 20090093

(51) Int. Cl.
*B66B 15/02* (2006.01)
*B66B 7/00* (2006.01)
(Continued)

(52) U.S. Cl.
CPC . *B66B 15/02* (2013.01); *B66D 3/04* (2013.01); *B66D 3/26* (2013.01); *B66B 11/008* (2013.01)

(58) Field of Classification Search
CPC ..... B66B 11/08; B66B 15/02; B66B 15/04; B66B 11/0075; B66B 11/008; B66D 1/365; B66D 3/046; F16B 9/02
USPC ..... 187/266, 262; 29/525.01, 525.03; 74/434, 166, 174; 254/280, 284, 334, 254/335, 405
IPC ..... B66B 7/00,11/00
See application file for complete search history.

(56) References Cited

U.S. PATENT DOCUMENTS 1,070,834 A * 8/1913 Nissen ..... 254/406
5,035,300 A * 7/1991 Chapelain et al. ..... 187/266
(Continued)

FOREIGN PATENT DOCUMENTS

EP 2000431 A1 12/2008
JP 53026049 A * 3/1978 ..... B66B 11/08
(Continued)

OTHER PUBLICATIONS

EPO Search Report, EP 10 75 0410, dated Jun. 23, 2014.

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

Diverting pulley arrangement of an elevator, which includes an axle, at least one diverting pulley that rotates while supported on the axle, a faceplate structure, in relation to which and supported by which the diverting pulley is arranged to rotate on the first side of the faceplate structure, which axle is locked so that it does not rotate in relation to the faceplate structure by the aid of a locking element, which locking element is on the second side of the faceplate structure and supported so that it does not move in relation to the faceplate structure. The locking element is placed against the locking surface included in the axle so that the contact point of the locking element and the locking surface of the axle is at least partly visible.

22 Claims, 3 Drawing Sheets

(51) Int. Cl.

| | |
|---|---|
| ***B66B 11/08*** | (2006.01) |
| ***B66D 3/04*** | (2006.01) |
| ***B66D 3/26*** | (2006.01) |
| *B66B 11/00* | (2006.01) |

(56) References Cited

U.S. PATENT DOCUMENTS

| | | | | |
|---|---|---|---|---|
| 2006/0231347 | A1* | 10/2006 | Mustalahti et al. | 187/266 |
| 2008/0289908 | A1* | 11/2008 | Murao et al. | 187/266 |

FOREIGN PATENT DOCUMENTS

| | | | | | |
|---|---|---|---|---|---|
| JP | 57-117408 | U | | 7/1982 | |
| JP | 58-123878 | U | | 8/1983 | |
| JP | 59-46973 | U | | 3/1984 | |
| JP | 59-170572 | U | | 11/1984 | |
| JP | 60-64312 | U | | 5/1985 | |
| JP | 5-262495 | A | | 10/1993 | |
| JP | 06201020 | A | * | 7/1994 | F16H 55/17 |
| JP | 09-156856 | A | | 6/1997 | |
| JP | 09194168 | A | * | 7/1997 | B66B 11/08 |
| WO | WO 2005/058740 | A1 | | 6/2005 | |

* cited by examiner

FIG. 4a
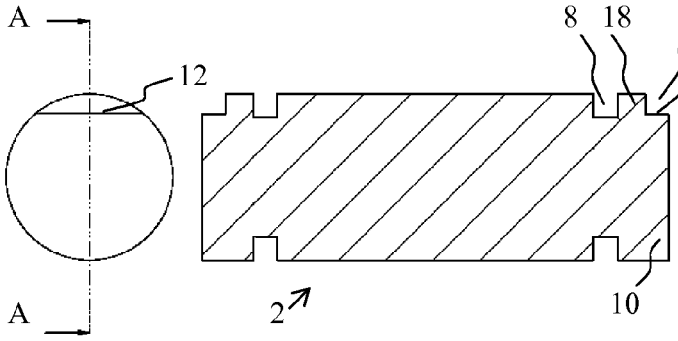
FIG. 4b
FIG. 5a
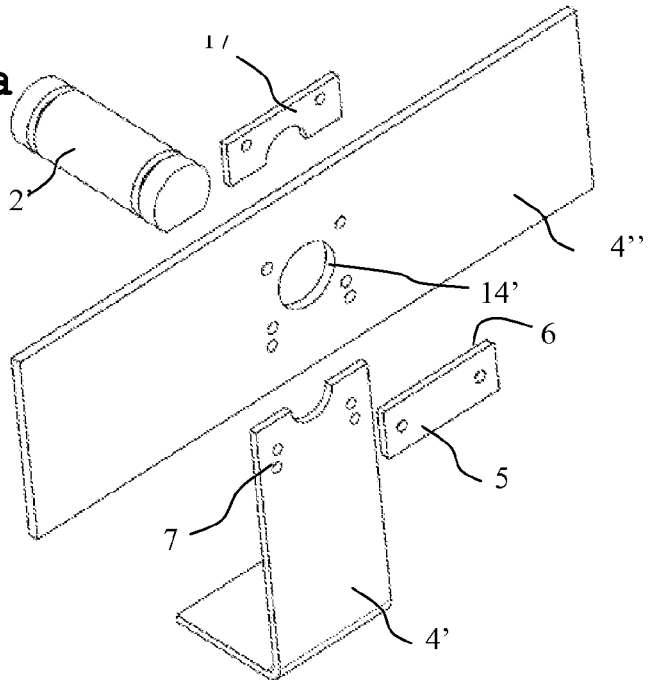
FIG. 5b
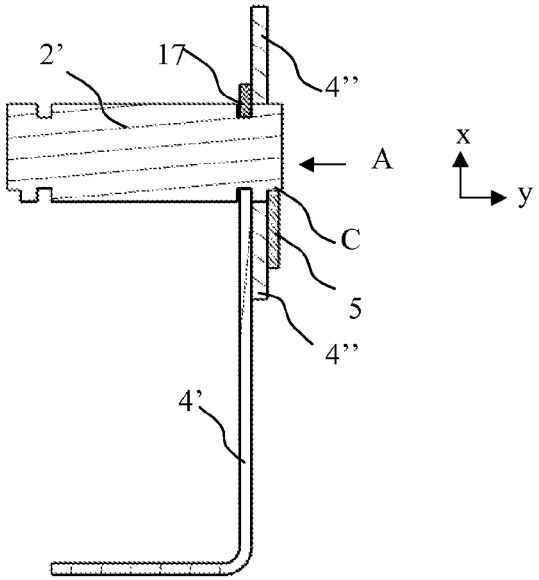

DIVERTING PULLEY ARRANGEMENT AND ELEVATOR

FIELD OF THE INVENTION

The object of the invention is a diverting pulley arrangement preamble

BACKGROUND OF THE INVENTION

In prior-art diverting pulleys the axle of the diverting pulley is locked into position with a locking plate that extends into a groove made in the axle. The groove is milled into the axle from the transverse direction, in which case the groove comprises a detent surface as viewed in the transverse direction of the axle, against which the locking plate is placed to lock the axle in position so that it does not rotate and does not move in the axial direction. A problem in these prior-art solutions is that when the locking plate breaks and allows the axle to rotate, movability of the axle is also enabled in the axial direction. Another problem in these prior-art solutions is that since the groove is milled in the solutions at a distance from the end of the axle, the detent surface that is against the locking plate has remained hidden behind the end of the axle. That being the case, it has not been possible to visually inspect the contact point of the locking plate and the detent surface of the axle. Inspecting this point is necessary so that, among other things, the condition of the locking plate can be determined and indirectly also the condition of the bearings. If servicing intervals are long, the condition of bearings can deteriorate over time so that the diverting pulley rotating on the axle starts essentially to try to rotate the axle. When the axle tries to rotate, the pressure exerted on the locking plate by the detent surface and also the wear resulting from to-and-fro loading increase. Verifying the condition of the locking plate has been laborious in prior art, because the diverting pulley structure has had to be opened for this purpose.

SUMMARY THE INVENTION

The aim of the invention is to eliminate, among others, the aforementioned drawbacks of prior-art solutions. More particularly the aim of the invention is to produce a safe diverting pulley arrangement and elevator that are improved from the standpoint of maintenance. The aim of the invention is further to produce one or more of the following advantages, among others:

- A solution is achieved with which it can be ensured that failure of the locking of the axle of the diverting pulley does not result in the axle moving out of its position.
- A solution is achieved with which servicing procedures can be speeded up and made more efficient.
- A solution is achieved in which the condition and possible wearing of the locking plate of the diverting pulley are more quickly detected than earlier.
- A solution is achieved in which deterioration of the condition of the bearings of the diverting pulley is more quickly detected than earlier.
- A solution is achieved in which the condition of the diverting pulley can be visually observed better than earlier.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

According to the invention the diverting pulley arrangement, which is preferably a diverting pulley arrangement of a hoisting device, more particularly a diverting pulley arrangement of an elevator, comprises an axle, at least one diverting pulley that rotates while supported on the axle, a faceplate structure on the side of the diverting pulley, in relation to which and supported by which the diverting pulley is arranged to rotate, and locking means supported on the faceplate structure on the side of the diverting pulley for locking the axle so that it does not rotate in relation to the faceplate structure. The arrangement also comprises positioning means supported on the faceplate structure on the side of the diverting pulley for positioning the axle in relation to the faceplate structure at least in the axial direction (y). One advantage is that since the arrangement thus comprises separate locking means and positioning means, when the locking element fails the axle the axle remains in its position to rotate. Thus damaging of the locking element or rupture pin, et cetera, does not eliminate the support of the diverting pulley.

In one embodiment of the invention the positioning means for positioning the axle prevent the axle from moving in either axial direction (y).

In one embodiment of the invention the locking means comprise a locking element, which prevents rotation of the axle, and the positioning means comprise a second locking element, which prevents the axle from moving in either axial direction (y).

In one embodiment of the invention the locking element comprised in the locking means and/or the positioning means for positioning the axle prevent the axle from moving in the radial direction (x).

In one embodiment of the invention the locking element is placed against the locking surface comprised in the axle so that the contact point of the locking element and the locking surface of the axle is at least partly visible, preferably in particular when viewed from the direction of the end of the axle. In this way it is possible for the contact point C to be inspected from the direction of the end of the axle, and the locking detent does not need to be detached for this purpose.

In one embodiment of the invention the positioning means for positioning the axle in the axial direction (y) in relation to the faceplate structure comprise a second locking element that is immovable in relation to the faceplate structure and that extends into the positioning recess in the axle, which positioning recess is preferably a positioning groove passing around it, which second locking element is preferably a part fixed to the faceplate structure or an edge structure of the faceplate structure.

In one embodiment of the invention the locking means comprise a locking element, which is placed against the locking surface comprised in the axle so that it prevents rotation of the axle.

In one embodiment of the invention the diverting pulley is arranged to rotate on the first side of the faceplate structure, and the aforementioned locking means comprise a locking element supported on the second side of the faceplate structure immovably in relation to the faceplate structure, by the aid of which the axle is locked so that it does not rotate in relation to the faceplate structure.

In one embodiment of the invention the axle comprises a locking indent in its end that extends to the second side of the faceplate structure, into which locking indent the aforementioned locking element that remains stationary in relation to the faceplate structure 4 is placed to prevent rotation of the axle, and the locking indent opens both in the longitudinal direction (y) and in the transverse direction of the axle, and the locking surface of the indent, which faces in the transverse direction (x) of the axle, forms a detent surface for the locking element to prevent rotation of the axle.

In one embodiment of the invention the contact point of the locking surface and of the locking element being against each other is at least partly visible, preferably for its whole length, when viewed from the direction of the second end of the axle, more particularly without the parts of the axle impairing the visibility of the contact point.

In one embodiment of the invention the locking element and the second locking element are separate parts.

In one embodiment of the invention the locking element is a plate, the extensive surface of which is essentially flush with the end surface of the second end of the axle. Thus visual inspectability is good.

In one embodiment of the invention the locking element is immovably fixed to the faceplate structure via at least one rupture pin. One advantage is that when the rolling resistance of the bearings grows too large, the rupture pin of the locking element fails and rotation of the diverting pulley can continue freely between the faceplates, in which case the rope guided onto the diverting pulley is not able to slip. In this way also shape deformation of the locking element can be limited, and the risks caused by shape deformation of the locking element can be avoided.

In one embodiment of the invention the positioning means comprise a second locking element that is immovable in relation to the faceplate structure, which second locking element is forked and comprises prongs that extend to the opposite sides of the axle, each of which prongs extends into the positioning recess of the axle and prevents the axle for moving in either axial direction (y). Thus the construction is simple and reliable.

In one embodiment of the invention the locking element is fixed against the locking surface comprised in the axle to be immovable in relation to the faceplate structure in the axial direction (y) by compressing the locking element against the fixing base, such as against the faceplate structure or a part fixed to it, with fixing means, and there is room for movement between the locking element and the fixing means that allows movement of the locking element in the radial direction (x) at least for a certain distance when the friction locking produced by compression fails. Thus it is possible to avoid broken parts.

In one embodiment of the invention the locking element comprises at least one, preferably two of the type of elongated apertures, via which the locking element is tightened with a moving bolt or corresponding in the axial direction (y) against a fixing base, such as against a faceplate structure or a part fixed to it, which aperture allows the locking element to move in the radial direction (x) at least a certain distance without being prevented by the aforementioned bolt or corresponding. Thus the desired distance can be set and the direction of movability of the parts limited.

In one embodiment of the invention after the locking element has moved a certain distance, the locking element allows rotation of the axle. Thus a diverting pulley that is stuck to its axle can start to rotate without breaking any pieces.

In one embodiment of the invention the locking element is directly or indirectly immovably fixed to the faceplate structure via a rupture pin and a bolt, the breaking threshold of which rupture pin is lower than that of the bolt. Thus the locking element remains in its position after a rupture.

In one embodiment of the invention when the rupture pin breaks, the locking element is arranged to bend away from its position against the locking surface around the fulcrum of the axial direction (y) formed at the point of the bolt. Thus the locking element moves out of the path of rotation and nevertheless remains in position to indicate failure of the locking.

In one embodiment of the invention the distance of the rupture pin from the fulcrum formed at the point of the bolt is smaller than the distance between the fulcrum and the most distant point of the contact point from the fulcrum. In this way, the dependency on the direction of rotation can be reduced.

According to the invention, the elevator, which is preferably a passenger elevator, comprises an elevator car, roping, which moves when the elevator is operated, such as e.g. hoisting roping and or compensating roping, and a diverting pulley arrangement, which diverting pulley arrangement comprises at least one diverting pulley arranged to rotate in the elevator hoistway and/or on the elevator car and/or on the counterweight, which diverting pulley is arranged to guide the passage of at least one rope or corresponding comprised in the aforesaid roping. The diverting pulley arrangement is any of the types defined above. In this way an elevator is achieved that has the advantages specified above.

According to the invention, in the method for determining the condition of a bearing comprised in a diverting pulley arrangement, preferably a diverting pulley arrangement of an elevator, the condition of the bearing is determined on the basis of the condition of the locking element, which locking element locks the axle so that it does not rotate in relation to the faceplate structure of the diverting pulley arrangement. The method is advantageous for the reason, among others, that the condition of the bearings can be determined also during normal operation from a moving diverting pulley, preferably e.g. from the diverting pulley of the counterweight. The diverting pulley arrangement is in this case such that that the locking element is placed against the locking surface comprised in the axle so that the contact point of the locking element and the locking surface of the axle is at least partly visible, preferably particularly when viewed from the direction of the end of the axle. Preferably the diverting pulley arrangement is any of the types described above.

In one embodiment of the method according to the invention the condition of the bearing is determined by inspecting the contact point of the locking surface of the axle and the locking element that are against each other, e.g. visually or with a feeler gauge, from the direction of the second end of the axle for shape deformations that have occurred in the locking surface and/or in the detent surface of the locking element.

On the other hand the invention could be defined otherwise than what is presented above. According to the second definition method, the diverting pulley arrangement, which is more particularly a diverting pulley arrangement of an elevator, comprises an axle, at least one diverting pulley that rotates while supported on the axle, a faceplate structure, in relation to which and supported by which the diverting pulley is arranged to rotate on the first side of the faceplate structure, which axle is locked so that it does not rotate in relation to the faceplate structure by the aid of a locking element, which locking element is on the second side of the faceplate structure and supported so that it does not move in relation to the faceplate structure. The locking element is placed against the locking surface comprised in the axle so that the contact point of the locking element and the locking surface of the axle is at least partly visible, preferably particularly when viewed from the direction of the end of the axle. In this way it is possible for the contact point C to be inspected from the direction of the end of the axle, and the locking detent does not need to be detached for this purpose. The additional features, and combinations thereof, presented of the embodiments above and of each claim can be combined with this diverting pulley arrangement.

BRIEF DESCRIPTION OF THE DRAWINGS

In the following, the invention will be described in detail by the aid of some embodiments with reference to the attached drawings, wherein

FIGS. 4*a* and 4*b* present an axle according to one embodiment of the invention for use in a diverting pulley arrangement of the invention.

FIG. 5*a* presents an explosion drawing of the parts used in a diverting pulley arrangement according to one embodiment of the invention.

FIG. 5*b* presents a cross-sectional view of an assembly drawing of the parts of FIG. 5*a*.

DETAILED DESCRIPTION OF THE INVENTION

Figure 1:
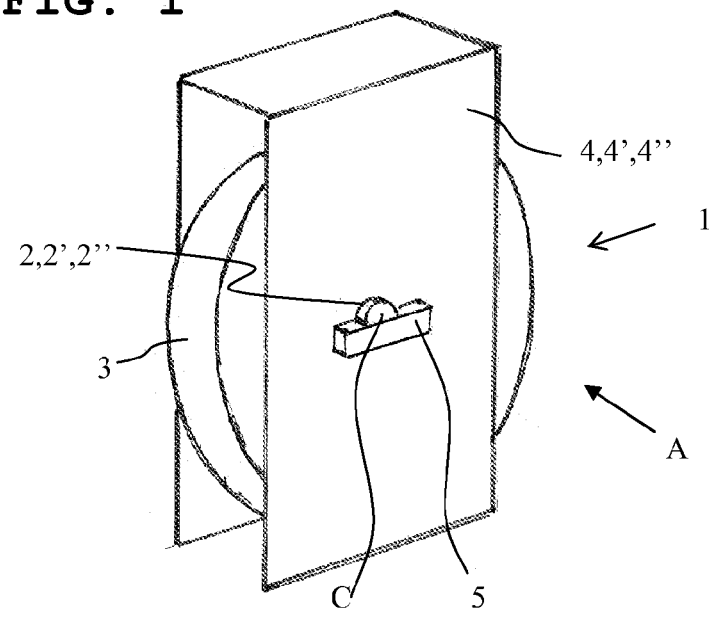
FIG. 1 presents a three-dimensional view of one diverting pulley arrangement according to one embodiment of the invention.

FIG. 1 presents in principle an assembly drawing of one diverting pulley arrangement 1 according to the invention, which comprises an axle 2,2',2", at least one diverting pulley 3 that rotates preferably around the axle while supported on the axle, a faceplate structure 4,4',4" on the side of the diverting pulley, which faceplate structure preferably comprises at least one faceplate, in relation to which and supported by which faceplate structure the diverting pulley 3 is arranged to rotate supported on the axle 2,2',2" on the first side of the faceplate structure. The axle 2,2',2" is locked so that it does not rotate in relation to the faceplate structure by the aid of a locking element 5, which locking element 5 is on the second side of the faceplate structure 4,4',4", which second side is on the opposite side to the first side and supported so that it does not move in relation to the faceplate structure 4,4',4". The locking element 5 is placed against the detent surface 6 of the axle 2 so that the contact point C of the locking element 5 and the detent surface of the axle is at least partly visible, preferably however visible for its whole length, when viewed from the direction of the end of the axle. This is brought about by shaping/arranging the parts of the arrangement so that the parts of the axle 2,2',2' do not impair the visibility of the contact point C in the direction of the end 10 of the axle. The locking element 5 is fixed immovably to the faceplate structure 4,4',4" via rupture pins 7. The locking element 5 is preferably a plate, the surface of which is essentially flush with the end surface of the axle 2,2',2". Thus the contact point C is easily visible when viewed from the direction A of the end of the axle, because the edge side on the side of the second end of the axle of the surface of the locking element 5 that is against the axle 2,2',2" is very visible. Likewise the edge side on the side of the second end of the axle of the surface of the detent surface 6 of the second end of the axle that is against the locking element 5 is very visible. The diverting pulley arrangement preferably, but not necessarily, comprises a bearing between the axle and the diverting pulley. If the bearing starts to fail, the axle starts to beat against the locking element and wear of the bearing is visible first as burnishing and then as flattening of the detent surfaces. The arrangement also comprises positioning means (8,13,17,18) supported on the faceplate structure (4,4',4") on the side of the diverting pulley 3 for positioning the axle 2,2',2" in relation to the faceplate structure (4,4',4") at least in the axial direction (y). These means are presented in connection with the embodiments.

Figure 2A:
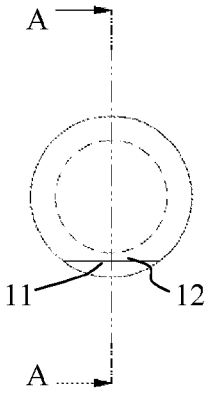
FIGS. 2*a* and 2*b* present an axle according to one embodiment of the invention for use in a diverting pulley arrangement of the invention.
Figure 2B:
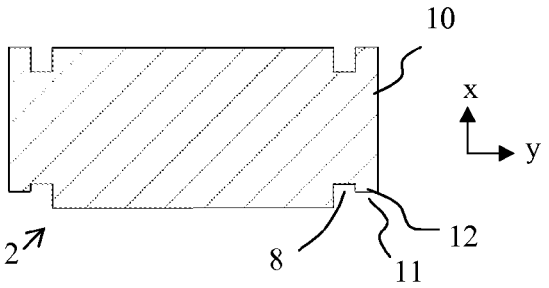
Figure 3A:
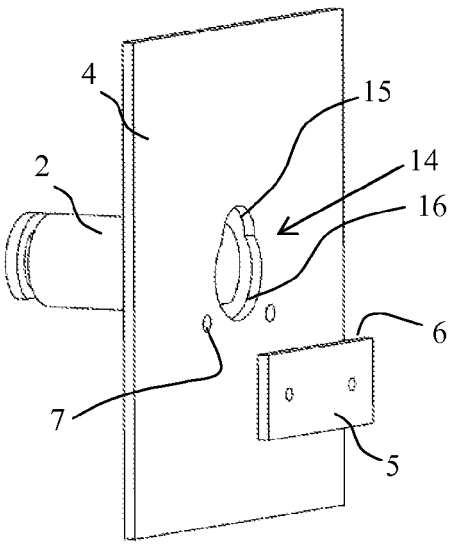
FIG. 3*a* presents an explosion drawing of the parts used in a diverting pulley arrangement according to one embodiment of the invention.
Figure 3B:
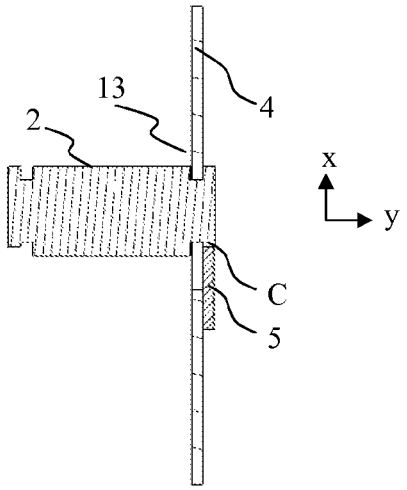
FIG. 3*b* presents an assembly drawing of the parts of FIG. 3*a* as a cross-sectional view.
Figure 8:
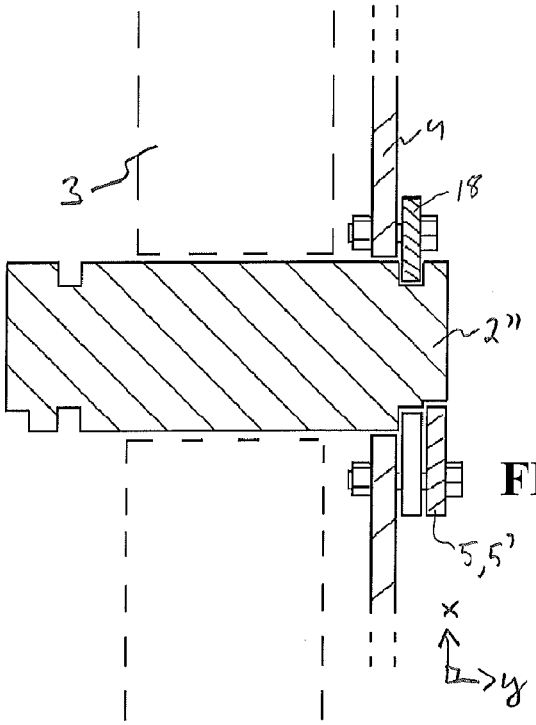
FIG. 8 presents a B-B and C-C section of FIGS. 6*a* and 7*a*.

FIGS. 2*a*-3*b* present one embodiment in the implementation of the arrangement of FIG. 1. FIG. 2*a* presents an axle 2 viewed from the direction A, and FIG. 2*b* presents a cross-sectional drawing (section A-A). FIGS. 2*a*, 2*b* and 3*a* present an explosion drawing of the parts used in a diverting pulley arrangement according to one embodiment of the invention. FIG. 3*b* presents an assembly drawing of the parts of FIG. 3*a* as a cross-sectional view. The axle 2 comprises a locking indent in its end 10 that extends to the second side of the faceplate structure 4, into which locking indent the aforementioned locking element 5 that remains stationary in relation to the faceplate 4 is intended to be placed to prevent rotation of the axle 2. The locking indent 11 opens both in the longitudinal direction x and in the transverse direction y of the axle, and the surface 12 of the indent 11, which faces in the transverse direction x of the axle 2, forms a detent surface used for locking for the locking element to prevent rotation of the axle 2. The axle 2 comprises a positioning recess 8 for positioning the axle 2 in relation to the faceplate 4 in the axial direction y, such as e.g. a positioning groove 8 passing around the axle, into which positioning groove the edge structure 13 of the aperture 14 extends. The locking element 5 is fixed to the faceplate structure 4 with fixing means 7, which are illustrated in simplified form in the drawings, and which fixing means preferably comprise at least one rupture pin. The diverting pulley arrangement can be supported in its installation position e.g. via the faceplate structure 4.

FIGS. 4*a*-5*b* present a second embodiment in the implementation of the arrangement of FIG. 1. FIGS. 4*a* and 4*b* present the axle 2' and FIG. 5*a* presents an explosion drawing of the parts used in a diverting pulley arrangement according to this embodiment (not all parts are shown). FIG. 3*b* presents an assembly drawing of the parts of FIG. 5*a* as a cross-sectional view. The axle 2' comprises a locking indent in its end 10 that extends to the second side of the faceplate structure 4',4", into which locking indent the aforementioned locking element 5 that remains stationary in relation to the faceplate 4 is intended to be placed to prevent rotation of the axle 2'. The locking indent 11 opens both in the longitudinal direction y and in the transverse direction x of the axle, and the surface 12 of the indent 11, which faces in the transverse direction x of the axle 2, forms a detent surface used for locking for the locking element to prevent rotation of the axle 2'. The axle 2' comprises a positioning recess 8 for positioning the axle 2' in relation to the faceplate structure 4',4" in the axial direction x, such as e.g. a positioning groove 8 passing around the axle. The locking surface 12 placed against the locking element 5 is separate from the positioning recess 8, separated by the neck 18. The arrangement comprises separate means 17 from the locking means 11,12,5 that prevent rotation for positioning the axle 2' in the axial direction. That being the case when the locking element 5 wears and possibly when it detaches, the axle starts to rotate supported on the faceplate positioned by different positioning elements, which improves the safety of the arrangement. The positioning means 8,17 and the locking means 5,11 are thus separate from each other and can form a separate invention that is independent of the rest of the construction of the diverting pulley arrangement. The faceplate structure comprises a first faceplate 4" and a second faceplate 4', which are fixed to each other with fixing means 7. A locking element 5 and a second locking element 17 are fixed to the faceplate structure 4',4" with fixing means 7, the illustrations of which are simplified in the drawings. The locking element is fixed to the faceplate 4" with fixing means, which comprise preferably at least one rupture pin. The diverting pulley arrangement can be supported in its installation position e.g. via the faceplate 4'. The faceplate structure (4',4") comprises an aperture 14', through which the end 10 of the axle 2,2' extends to the second side of the faceplate structure (4',4"), and the faceplate structure (4', 4") extends into the positioning groove 8 of the axle 2'. The aperture 14' is formed to comprise a more extensive section 16, from which the axle 2 can be pushed through, and a narrower section 15, to the point of which the axle 2 pushed through from the aperture 14' can be moved in the direction of the plane of rotation of the axle from the point of the more extensive aperture 16, and when the axle 2 is at the point of the narrower section 15 the faceplate structure (4',4") extends (in the radial direction) into the positioning recess 8 and prevents movement of the axle 2 in the axial direction y. When the axle 2' is positioned by means of the locking groove 8, the second locking element 17 prevents the axle (2,2') from moving in the radial direction of the axle out of the position that is positioned by means of the locking groove 8.

Generally speaking, the indent 11 opens in the transverse direction x and in the axial, i.e. longitudinal, direction y, as presented above. The indent in this case comprises a surface 12 that faces essentially in the transverse direction x, but preferably the surface 12 faces directly in the transverse direction x when the direction x is at a right angle to the longitudinal direction of the axle, which is the direction of the rotational axis of the axle. The indent opens in addition to this in the longitudinal direction y, preferably but not necessarily for its whole length. The locking surface 12 of the indent that opens in the longitudinal direction y faces most preferably in the transverse direction x, in which case formation of support forces in the axial direction is avoided, but the locking surface 12 could alternatively also be slightly inclined in the direction of the end 10. With these arrangements, since the indent opens in the direction y, when placing the locking element in the indent the contact point C of the locking element and the locking surface 12 is visible from the direction A of the end 10 of the axle 2,2' without the parts of the axle 2 blocking visibility.

The locking surface 12 of the indent 11 is preferably flat and parallel with the surface of the faceplate 5, which surface forms a detent surface for the locking surface 12. The locking element is preferably a plate, preferably a rectangular polyhedron, one straight edge side of which forms a surface to be placed against the detent surface of the axle. The indent 11 extends preferably from flush with the end of the axle 3-10 mm, most preferably 3-7 mm, in the longitudinal direction. The indent that is in the end 10 and that opens towards the longitudinal direction is preferably a cavity, which is preferably round in its cross-sectional shape, milled in the axle. There can be a plurality of diverting pulleys supported on the axle, in which case the diverting pulleys of the diverting pulley plurality can each have separate bearings or can have a common bearing.

The contact point C between the axle and the locking element can be arranged to remain visible in other ways than by making an indent that opens in the longitudinal and transverse directions of the axle. The end of the axle can e.g. be formed to comprise a projection that protrudes from the axle in its radial direction, which projection comprises a detent surface facing in essentially the tangential transverse direction of the axle, against which surface the locking element can be placed.

The rope attempts to rotate the diverting pulley with the frictional force Fμ between them. When the condition of the bearings is weak, the force from movement of the rope is transmitted to the locking element 5. The rupture pin is preferably dimensioned to break before slipping between the diverting pulley and the rope guided by the diverting pulley starts to occur. Preferably the rupture pin is dimensioned to break when the rope exerts on the diverting pulley 40-60%, more preferably approx. 50%, of the force at which slipping would start. In this way shape deformation of the locking element 5 can be limited, and the risks caused by shape deformation of the locking element can be avoided. The fixing means 7 in the figures are preferably normal fixing means in the other parts of the diverting pulley, and only the fixing means 7 of the locking element comprise a rupture pin/rupture pins.

The embodiments of the invention presented in FIGS. 6*a*-8, in which the axle is locked with locking means so that it does not rotate and which arrangement additionally comprises positioning means (8,18) supported on the faceplate structure 4 on the side of the diverting pulley 3 for positioning the axle 2" in relation to the faceplate structure (4,4',4") in the axial direction (y), which means prevent the axle 2" from moving in either axial direction (y). As in the preceding embodiments, in these also the positioning means and the locking means are supported on the faceplate structure on the same side of the diverting pulley. The locking elements can be fixed directly, or via another part, to the faceplate structure. The positioning means (8,18) of the arrangement comprise a second locking element 18 that is immovable in relation to the faceplate structure 4, which second locking element is forked and comprises prongs h that extend to the opposite sides of the axle 2", each of which prongs extends into the positioning recess 8 and prevents the axle 2" from moving in either axial direction (y). The locking principle of the axle 2" so that it does not rotate corresponds in these embodiments to the earlier embodiments. The difference is only the fixing method of the locking element 5,5'.

Figure 6A:
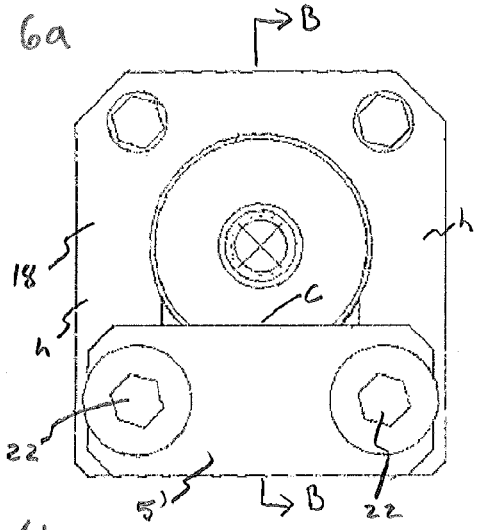
FIG. 6*a* presents a method according to one embodiment of the invention for positioning and locking an axle.
Figure 6B:
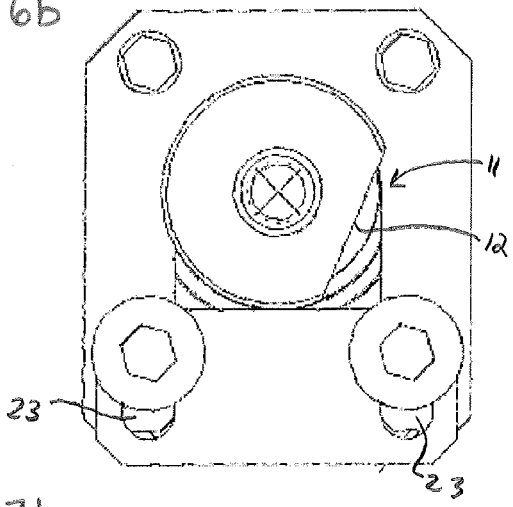
FIG. 6*b* presents the situation of the embodiment according to FIG. 6*a*, wherein the friction locking has failed.

In the embodiment of FIGS. 6*a* and 6*b*, the locking element 5' is fixed against the locking surface 12 comprised in the axle 2" to be immovable in relation to the faceplate structure in the axial direction (y) by compressing the locking element 5' against a part 18 fixed to the faceplate structure 4 with fixing means. There is room for movement between the locking element 5' and the fixing means that allows movement of the locking element in the radial direction (x) at least for a certain distance when the friction locking produced by compression fails. This is made possible because the locking element 5' comprises two of the type of elongated apertures 23, via which the locking element 5' is tightened with a moving bolt 22 or corresponding in the axial direction (y) against a fixing base, which aperture 23 allows the locking element 5' to move in the radial direction (x) at least a certain distance without being prevented by the aforementioned bolt 22 or corresponding. After the locking element 5' has moved a certain distance, the locking element 5' allows rotation of the axle 2" This situation is presented in FIG. 6*b*.

Figure 7A:
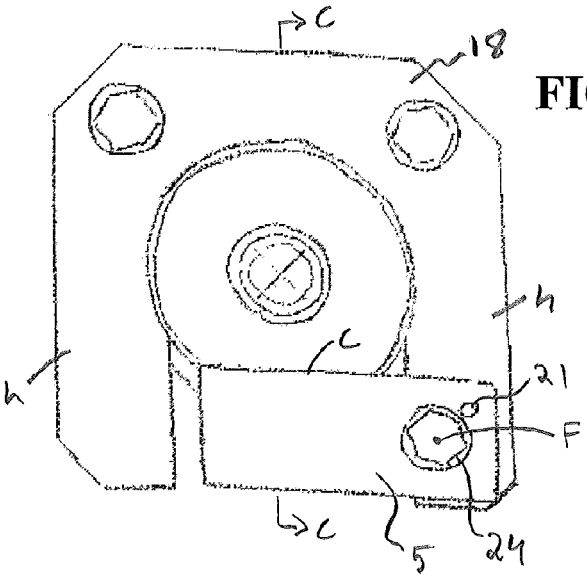
FIG. 7*a* presents a method according to one embodiment of the invention for positioning and locking an axle.
Figure 7B:
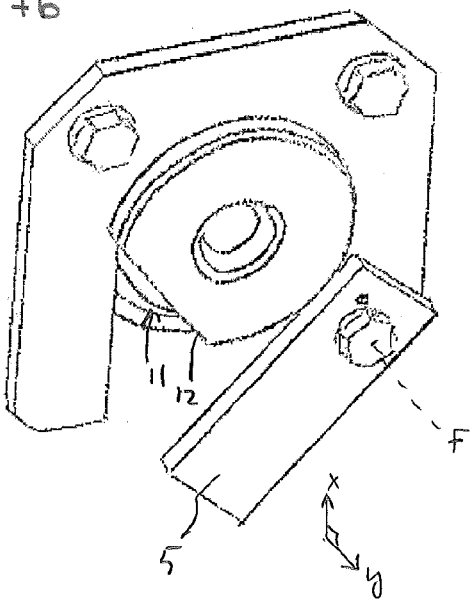
FIG. 7*b* the situation of the embodiment according to FIG. 7*a*, wherein the rupture pin has snapped.

In the embodiment presented in FIGS. 7*a* and 7*b*, the locking element 5 is directly or indirectly immovably fixed to the faceplate structure 4 via a rupture pin 21 and a bolt 24, the breaking threshold of which rupture pin 21 is lower than that of the bolt 24. When the rupture pin 21 breaks, the locking element 5 is arranged to bend away from its position against the locking surface 12 around the fulcrum F of the axial direction (y) formed at the point of the bolt 24. The distance of the rupture pin 21 from the fulcrum F formed at the point of the bolt 24 is smaller than the distance d between the fulcrum F and the most distant point of the contact point C from the fulcrum F. Thus the arrangement behaves less dependently on the direction of rotation. The effect of the direction of rotation of the axle required for breaking is less than before.

In the method according to the invention for determining the condition of a bearing comprised in a diverting pulley arrangement of an elevator, e.g. a passenger elevator, the condition of the bearing is determined on the basis of the condition of the locking element 5, which locking element 5 locks the axle 2,2',2" so that it does not rotate in relation to the faceplate structure (4,4'4") of the diverting pulley arrangement 1. The condition of the bearing is determined by inspecting from the direction A of the second end of the axle 2,2',2" for any shape deformations that have occurred in the locking surface 12 and/or in the detent surface 6 of the locking element in the contact point C of the locking surface 12 and the locking element 5 that are against each other. In the method the elevator and/or diverting pulley arrangement 1 is preferably presented somewhere else in this application, e.g. in FIGS. 1-5*b*. If shape deformations are detected, a need to replace the bearing of the axle is diagnosed. More particularly, if the clearance between the surface 6 and the surface 12 has increased, it is a sign of bearing damage. The method is advantageous for the reason, among others, that the condition of the bearings can be determined also during normal operation from a moving diverting pulley, e.g. from the diverting pulley of the counterweight. Determining the bearing condition on e.g. the aural principle would be impossible.

For the sake of clarity, the bearing is not presented in the drawings, nor is the diverting pulley 3 in all the drawings. The bearing is preferably any prior-art bearing, in which case the bearing, e.g. ball bearings, is around the axle 2,2',2" and the diverting pulley structure 3 is on the rim of the bearing. The bearing can be on the axle in a fixed or rotating manner, however preferably so that it enables rotation between the axle 2,2',2" and the diverting pulley 3.

The elevator according to the invention is an elevator, e.g. an elevator applicable to passenger traffic, that comprises an elevator car, roping, which moves when the elevator is operated, such as e.g. hoisting roping and or compensating roping, and a diverting pulley arrangement 1, which diverting pulley arrangement 1 comprises at least one diverting pulley 3 arranged to rotate in the elevator hoistway and/or on the elevator car and/or on the counterweight, which diverting pulley is arranged to guide the passage of at least one rope or corresponding comprised in the aforesaid roping. The diverting pulley arrangement is according to any of claims 1-10.

It is obvious to the person skilled in the art that the invention is not limited to the embodiments described above, in which the invention is described using examples, but that many adaptations and different embodiments of the invention are possible within the frameworks of the inventive concept defined by the claims presented below. Thus, for example, it is obvious that although the structure of only one end of the axle is described above, it is clear that both ends of the axle can comprise functions and/or structures that are similar to those described above. Likewise, the faceplate structure can be similar in its functions and/or structures on both sides of the diverting pulley/diverting pulley plurality supported by the axle.

The invention claimed is:

1. A diverting pulley arrangement of an elevator, the diverting pulley arrangement comprising an axle, at least one diverting pulley that rotates while supported on the axle, a faceplate structure on a side of the diverting pulley, in relation to which and supported by which the diverting pulley is arranged to rotate, a locking mechanism supported on the faceplate structure on the side of the diverting pulley for locking the axle so that the axle does not rotate in relation to the faceplate structure, wherein the diverting pulley is arranged to rotate on a first side of the faceplate structure, and the locking mechanism comprises a locking element supported on a second side of the faceplate structure immovably in relation to the faceplate structure, and a positioning mechanism supported on the faceplate structure on the side of the diverting pulley for positioning the axle in relation to the faceplate structure at least in an axial direction, wherein the axle has a main body located on the first side of the faceplate structure and an end portion located on the second side of the faceplate structure, the end portion has a locking indent on the second side of the faceplate structure, the locking indent extends from an axial end of the axle toward the faceplate structure, a radius of a cross section of the end portion at the axial end of the axle where the locking indent is located, and from which the locking indent extends, is smaller than a radius of a cross section of the main body on the first side of the faceplate structure, and the cross section of the end portion and the cross section of the main body are both taken in planes perpendicular to an axial direction, and wherein the locking indent is engaged with the locking element on the second side of the faceplate structure, thereby preventing the axle from rotating in relation to the faceplate structure, wherein the axial end is a terminus of the axle.

2. The diverting pulley arrangement according to claim 1, wherein the positioning mechanism comprises a second locking element, which prevents the axle from moving in the axial direction.

3. The diverting pulley arrangement according to claim 2, wherein the locking element comprised in the locking mechanism and/or the positioning mechanism for positioning the axle also prevents the axle from moving in the radial direction.

4. The diverting pulley arrangement according to claim 2, wherein the locking element and the second locking element are different parts.

5. The diverting pulley arrangement according to claim 2, wherein the faceplate structure comprises an aperture through which the end portion of the axle extends to the second side of the faceplate structure, and an edge structure of the aperture and/or the second locking element extends into a positioning groove of the axle, for preventing movement of the axle in the axial direction and/or a radial direction.

6. The diverting pulley arrangement according to claim 1, wherein the locking indent opens both in a longitudinal direction and in a transverse direction of the axle, and a locking surface of the indent, which faces in the transverse direction of the axle, forms a detent surface for the locking element to prevent rotation of the axle.

7. The diverting pulley arrangement according to claim 6, wherein contact between the locking surface and the locking element is at least partly visible when viewed from a direction of the axial end of the axle.

8. The diverting pulley arrangement according to claim 1, wherein the positioning mechanism for positioning the axle prevents the axle from moving in the axial direction.

9. The diverting pulley arrangement according to claim 1, wherein the locking element is placed against a locking surface comprised in the axle so that a contact point of the locking element and the locking surface of the axle is at least partly visible when viewed from a direction of the axial end of the axle.

10. The diverting pulley according to claim 1, wherein the positioning mechanism for positioning the axle in the axial direction in relation to the faceplate structure comprises a second locking element that is releasably secured to the faceplate structure and that extends into a positioning recess in the axle, the positioning recess being a positioning groove passing around the axle, the second locking element being a part fixed to the faceplate structure or an edge structure of the faceplate structure.

11. The diverting pulley arrangement according to claim 1, further comprising a bearing between the axle and the diverting pulley.

12. The diverting pulley arrangement according to claim 1, wherein the locking element is a plate, an extensive surface of which is essentially flush with the end surface of the axial end of the axle.

13. The diverting pulley arrangement according to claim 1, wherein the locking element is fixed immovably to the faceplate structure via at least one rupture pin.

14. The diverting pulley arrangement according to claim 1, wherein an aperture comprised in the faceplate structure is formed to comprise a first section, from which the axle can be pushed through, and a second section narrower than the first section, to a point of which the axle pushed through from the aperture can be moved in a direction of the plane of rotation of the axle from the point of the first section, and when the axle is at the point of the second section, the faceplate structure extends into a positioning recess of the axle and prevents movement of the axle in the axial direction.

15. The diverting pulley arrangement according to claim 1, wherein the positioning mechanism comprises a second locking element that is immovable in relation to the faceplate structure, wherein the second locking element is forked and comprises prongs that extend to opposite sides of the axle, each of which prongs extends into a positioning recess of the axle and prevents the axle from moving in the axial direction.

16. The diverting pulley arrangement according to claim 1, wherein the locking element is fixed against a locking surface comprised in the axle to be immovable in relation to the faceplate structure in the axial direction by compressing the locking element against the faceplate structure or a part fixed to the faceplate structure, with at least one rupture pin, and wherein movement between the locking element and the at least one rupture pin allows movement of the locking element in a radial direction at least for a predetermined distance when a friction locking produced by compression fails.

17. The diverting pulley arrangement according to claim 1, wherein the locking element comprises at least one elongated aperture via which the locking element is tightened with a moving bolt in the axial direction against the faceplate structure or a part fixed to the faceplate structure, and the aperture allows the locking element to move in a radial direction at least a predetermined distance without being prevented by the bolt.

18. The diverting pulley arrangement according to claim 1, wherein limited disengagement of the locking element with the axle permits rotation of the axle.

19. A diverting pulley arrangement of an elevator, the diverting pulley arrangement comprising an axle, at least one diverting pulley that rotates while supported on the axle, a faceplate structure on a side of the diverting pulley, in relation to which and supported by which the diverting pulley is arranged to rotate, a locking mechanism supported on the faceplate structure on the side of the diverting pulley for locking the axle so that the axle does not rotate in relation to the faceplate structure, and a positioning mechanism supported on the faceplate structure on the side of the diverting pulley for positioning the axle in relation to the faceplate structure at least in an axial direction, wherein the locking mechanism comprises a locking element, said locking element is fixed to the faceplate structure via a rupture pin and a bolt, a rupture threshold of which rupture pin is lower than that of the bolt.

20. The diverting pulley arrangement according to claim 19, wherein rupture of the rupture pin allows the locking element to pivotally disengage a locking surface of the axle about a fulcrum formed in an axial direction of the bolt.

21. The diverting pulley arrangement according to claim 20, wherein a distance of the rupture pin from the fulcrum formed at the point of the bolt is smaller than a distance between the fulcrum and a most distant point of contact by an engagement between the locking element and the locking surface of the axle, from the fulcrum.

22. An elevator, which comprises:

an elevator car;

a roping, the roping moving when the elevator is operated; and the diverting pulley arrangement according to claim 1, wherein the diverting pulley arrangement comprises the at least one diverting pulley arranged to rotate in the elevator hoistway, on the elevator car or on a counterweight, and the diverting pulley is arranged to guide passage of at least one rope comprised in the roping.

* * * * *